United States Patent [19]

Campbell

[11] 3,969,962

[45] July 20, 1976

[54] FRICTION DRIVE WRENCH

[75] Inventor: Theodore A. Campbell, Paradise, Calif.

[73] Assignee: C.M.T. Co., Paradise, Calif.

[22] Filed: May 27, 1975

[21] Appl. No.: 580,669

[52] U.S. Cl. ..... 81/60

[51] Int. Cl.[2] ..... B25B 13/46

[58] Field of Search ..... 81/58, 60; 192/80, 79, 192/81

[56] References Cited

UNITED STATES PATENTS

| | | | |
|---|---|---|---|
| 2,735,324 | 2/1956 | Goldwater et al. | 81/60 |
| 2,766,648 | 10/1956 | Jazwieck | 81/60 |
| 2,824,476 | 2/1958 | Wilson | 81/58 |
| 3,656,376 | 4/1972 | Campbell | 81/58 |

*Primary Examiner*—James L. Jones, Jr.
*Attorney, Agent, or Firm*—F. Travers Burgess

[57] ABSTRACT

A wrench includes an elongated shank, an axial cavity in one end of the shank, a radially split annular driving member formed with radial tangs fitting into the axial cavity in the shank, a cylindrical head mounted within the driving member and frictionally gripped thereby, and manually actuable means whereby the grip is increased during forward movement of the shank in a selected direction and released during back-up movement of the shank.

7 Claims, 9 Drawing Figures

FRICTION DRIVE WRENCH

BACKGROUND OF THE INVENTION

1. Field of the Invention

The invention relates to wrenches having selectively reversible friction clutches for providing ratchet-type action.

2. The Prior Art

The closest approach in the prior art to my wrench is disclosed in Theodore A. Campbell et. al. U.S. Pat. No. 3,656,376 in which the wrench has a split annular body member with tangs extending into an axial cavity in the shank, but is normally in nongripping relation with the cylindrical head, the gripping effect being achieved by rotation of the shank about the axis of the work so that the diagonal position of the tangs in the cavity causes the tangs to close the gap between them and thereby reduce the inside diameter of the body until the same is in gripping engagement with the head, rotary movement of the shank in the opposite direction releasing the head and permitting the shank to be backed up to starting position without causing similar back-up of the head.

SUMMARY OF THE INVENTION

The invention provides a friction-actuated ratchet-type action wrench in which the driving body and head are constantly, during operation, in a stable stationary position with respect to the shank and which is easily reversible by a simple manually-actuated means.

DETAILED DESCRIPTION OF THE INVENTION

Figure 1:
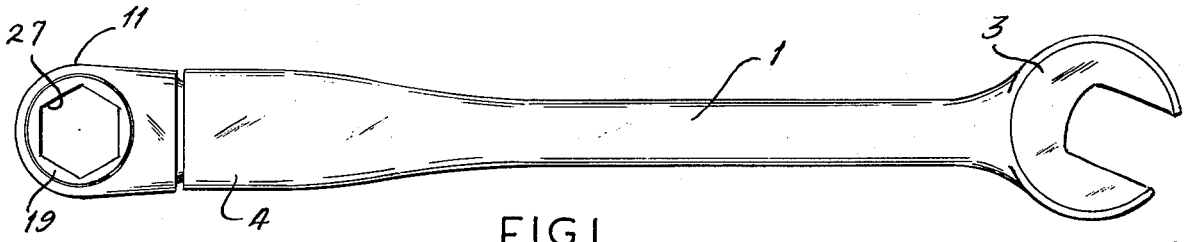
FIG. 1 is a plan view of a wrench embodying the invention.
Figure 2:
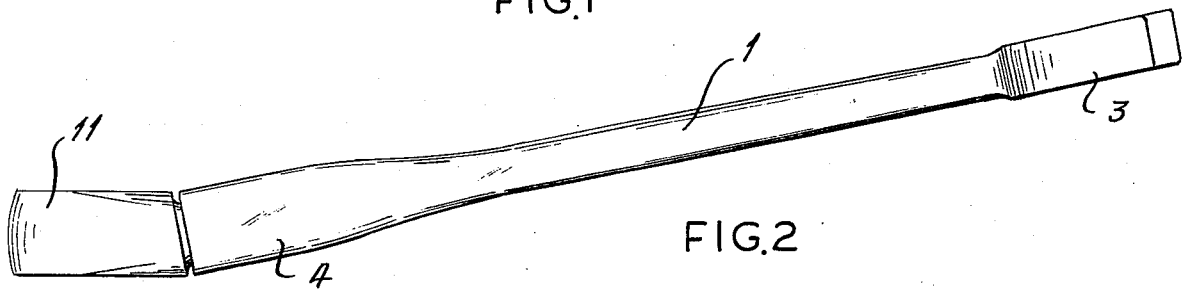
FIG. 2 is a side elevational view of the wrench illustrated in FIG. 1.

The wrench has an elongated metal shank 1, which may be formed at one end with a conventional open-end wrench head 3 and at its other end is thickened as at 4 and formed with a deep cavity 7 of oblong cross section.

An annular driving member or gripping eye 11 is split radially and is formed on both sides of the split with generally radial tangs 13*a* and 13*b*, the aggregate width of which in a direction tangential to the opening in gripping eye 11 is slightly less than the long dimension of the cavity cross section, permitting the tangs to extend freely thereinto, the thickness of the tangs being sufficiently less than the short dimension of the cavity cross section to permit their sliding mounting therein.

A cylindrical head 19, the driven member, normally is tightly received in the opening in gripping eye 11. Head 19 may be formed with a central aperture 21 of hexagonal shape for engagement with a nut or bolt head of this shape. For locking head 19 within gripping eye 11, the outer cylindrical surface 23 of head 19 is formed with a central annular groove 25, the inner cylindrical surface 27 of gripping eye 11 is formed with a similarly positioned annular groove 29, and a split wire ring 31 is fitted into head annular groove 25. With gripping eye 11 fully expanded by opening the slit between the tangs, the head is inserted into the opening in the gripping eye until the flat transverse surfaces of the head are flush with the transverse surfaces of the gripping eye. With this arrangement, when gripping eye 11 is in its normally compressed condition, ring 31 by engagement with the surfaces of grooves 25 and 29 prevents relative movement of head 19 and gripping eye 11 axially of the opening in the gripping eye, thus locking the head within the gripping eye.

Gripping eye 11 is normally in tight gripping engagement with head 19.

Near their inner ends, tangs 13*a* and 13*b* are formed with opposed arcuate recesses 35 and a key-like member 37, journaled at 36 and 38 in the shank walls defining the long sides of the cavity, passes through cavity 7 and the space between tang recesses 35, 35 and has an eccentric projection 39 rotatable from a central position in registry with the split between tangs 13*a* and 13*b* to positions in which it engages either tank in the respective recess 35. A spring loaded plunger or detent 41 seated in an axial bore 43 in the shank communicates with the bottom of cavity 7 and selectively engages flats 45, 46 and 47 on key 37 for maintaining the latter in selected positions. At its outer end projecting from the outer surface of the shank end portion, key 37 is formed with an enlarged disc-shaped operating knob 49 having a raised indicator surface 51 to show the direction in which the key is pointed and to facilitate manual rotation of the key to desired positions.

Figure 6:
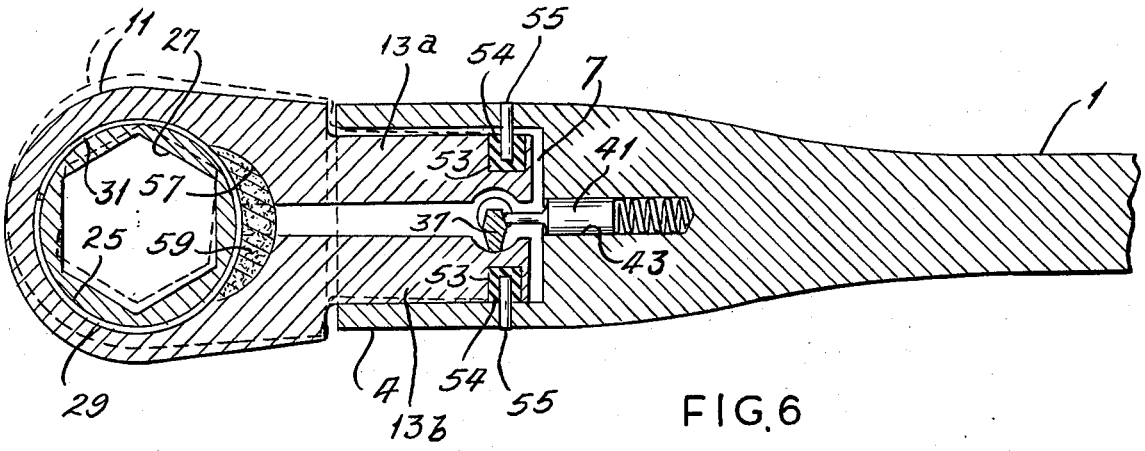
FIG. 6 is a sectional view corresponding to FIG. 5 but showing the wrench arranged for unidirectional operation in a counterclockwise direction.
Figure 7:
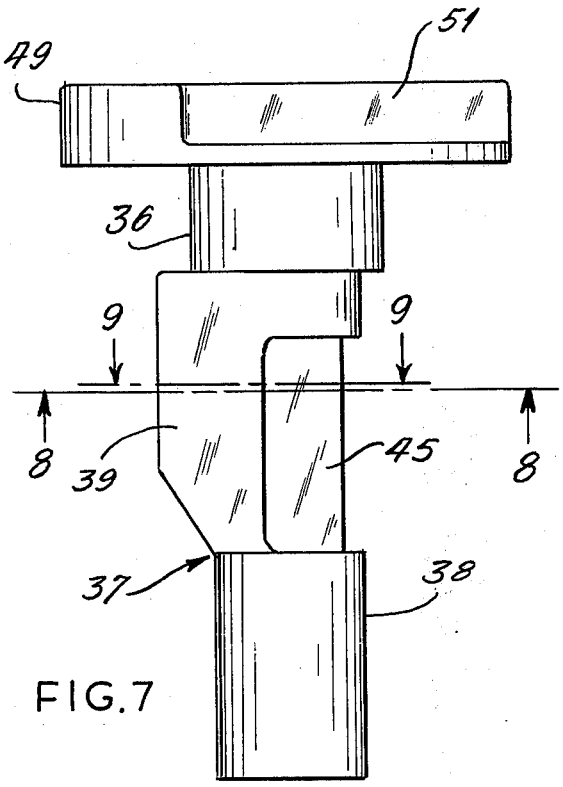
FIG. 7 is an enlarged view of the reversing key incorporated in the wrench.
Figure 8:
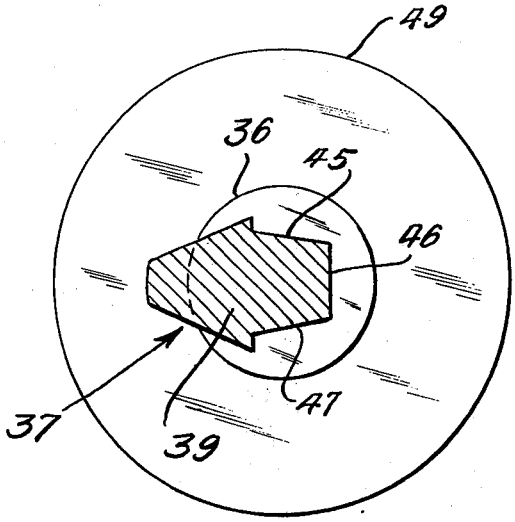
FIGS. 8 and 9 are enlarged transverse sectional views of the reversing key taken along lines 8—8 and 9—9 respectively of FIG. 7.
Figure 9:
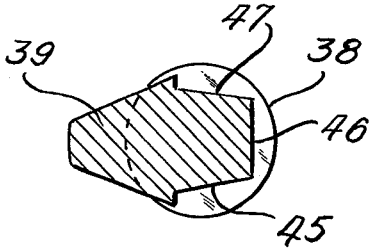

When the key projection is rotated to the left as shown in FIG. 6, it urges tang 13*b* against the left wall of cavity 7, so that if the shank is moved counterclockwise to release a right-hand-threaded bolt or nut, the grip of gripping eye 11 on head 19 will be tightened as the gripping eye member assumes the broken-line position of FIG. 6 with respect to shank 1. Conversely, if the shank is moved clockwise, pressure of gripping eye 11 on head 19 will be released and the shank can be freely backed up to starting position in the manner of a ratchet wrench.

If key 37 is pointed in the opposite direction, that is, with projection 38 to the right, movement of the shank clockwise will tighten the grip of gripping eye 11 on head 19 and counterclockwise back-up movement of the shank will free it.

Figure 3:
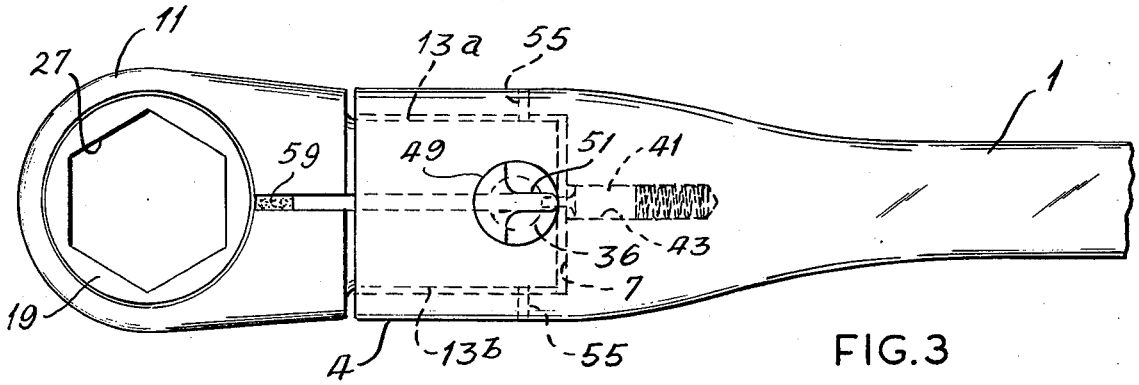
FIG. 3 is an enlarged plan view of the operating end portion of the wrench illustrated in FIGS. 1 and 2.
Figure 4:
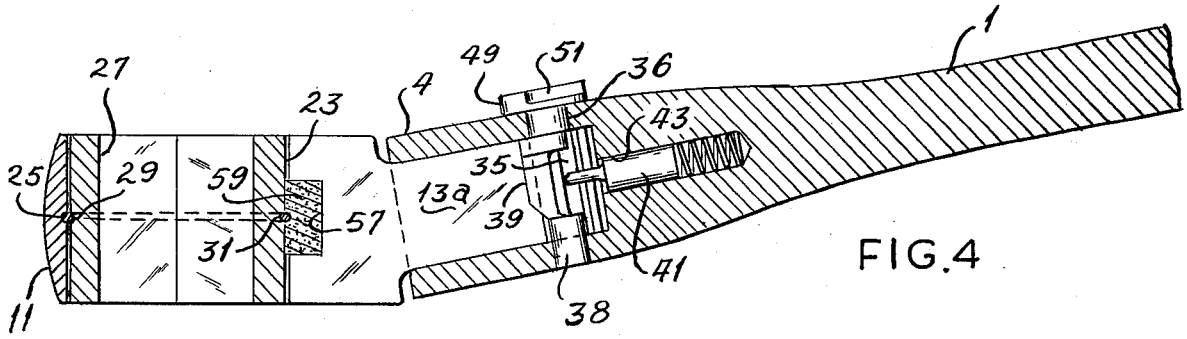
FIG. 4 is a longitudinal sectional view taken along line 4—4 of FIG. 3.
Figure 5:
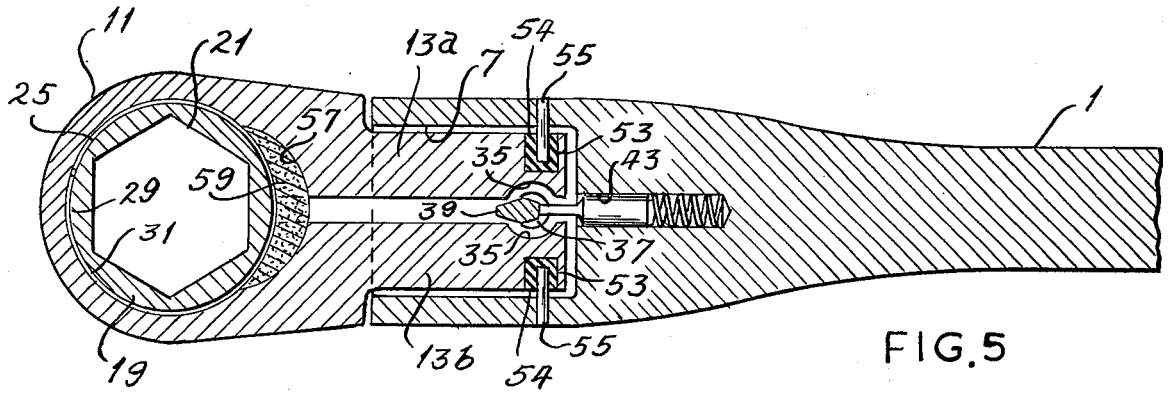
FIG. 5 is a horizontal longitudinal sectional view taken along line 5—5 of FIG. 4 showing the wrench in neutral position.

If the key is positioned as in FIGS. 3, 4 and 5, with projection 38 centered, the grip will be tight in both directions, and the wrench will behave like a fixed-head wrench.

For retaining gripping eye 11 in assembled relation with shank 1, the extremities of tangs 13*a* and 13*b* are formed with transverse shallow bores 53 facing the sides of cavity 7 filled with yieldable material such as synthetic rubber or tetrafluoroethylene 54 into which roll pins 55 project from the side walls of cavity 7, the plastic material being sufficiently yieldable to accommodate necessary tipping movements of tangs 13*a* and 13*b* in the cavity.

To insure tight gripping engagements between gripping eye 11 and head 19, a crescent-shaped pocket 57 is formed in the gripping eye in communication with surface 27 of the opening therein, and a pad 59 of felt or similar material is positioned in pocket 57 and is soaked with a petroleum-based low tension lubricant for wiping engagement with external surface 23 of head 19. The lubricant so completely fills the space between the inner surface of the gripping eye and the head that it enhances gripping engagement between the gripping eye and head rather than lubricating the opposing surfaces of these elements.

It will be understood that clutches of this type may be used in devices other than wrenches.

The details of the structure may be varied substantially without departing from the spirit of the invention and the exclusive use of such modifications as come within the scope of the appended claims is contemplated.

I claim:

1. A wrench having an elongated shank, an axial cavity in one end of said shank, an annular gripping eye member split radially of itself and having a pair of radial tangs separated by the radial split extending into said cavity with their outer sides spaced from the sides of said cavity to permit limited tipping of said tangs therein in a plane normal to the axis of said gripping eye member, a cylindrical head member grippingly positioned in said gripping eye, and a key-like member rotatably journaled in shank wall structure defining said cavity and extending parallel to the axis of said eye member through said cavity and between said tangs and having an eccentric projection alternatively engageable with the opposing surfaces of one or the other of said tangs for biasing said tangs in selected directions circumferential of the axis of said gripping eye member in said cavity whereby movements of said shank in opposite directions causes tightening of said gripping eye member on said head member and back-up movements of said shank releases the grip of said gripping eye member on said head member.

2. A wrench according to claim 1 wherein said key-like member projection is positionable in the space between said tangs by rotation of said key-like member whereby to cause said gripping eye member to retain its grip on said head member irrespective of the direction in which said shank is moved.

3. A wrench according to claim 2 wherein the opposing faces of said tangs are formed with opposed arcuate recesses surrounding said key-like member and alternatively engageable with the eccentric projection thereon.

4. A wrench according to claim 3 wherein said shank mounts a detent, and said key-like member has surfaces engageable with said detent when said key-like member is in a selected position whereby said detent yieldingly maintains said key-like member in such selected position.

5. A wrench according to claim 4 wherein each of said tangs has an insert of yieldable material in its side remote from said recess and removable elements project from the opposing walls of said cavity into said inserts for removably retaining said tangs in said cavity and accommodating limited tipping of said tangs therein in a plane normal to the axis of said gripping eye.

6. A wrench according to claim 4 wherein said key-like member surfaces are flats on the key and said detent is a plunger recessed in said shank and resiliently biased into engagement with a respective flat when said key-like member is in any of its three operative positions.

7. A wrench according to claim 1 wherein said gripping eye member is formed with a pocket communicating with the head member mounting opening therein, there being a pad of absorptive material in said pocket in wiping engagement with the opposing surface of said head member.

* * * * *